US012185810B2

(12) United States Patent
Bracen

(10) Patent No.: US 12,185,810 B2
(45) Date of Patent: Jan. 7, 2025

(54) MULTI-MODE LUGGAGE APPARATUS AND METHOD

(71) Applicant: Phil and Teds Design Limited, Wellington (NZ)

(72) Inventor: Philip John Bracen, Wellington (NZ)

(73) Assignee: PHIL AND TEDS DESIGN LIMITED, Wellington (NZ)

( * ) Notice: Subject to any disclaimer, the term of this patent is extended or adjusted under 35 U.S.C. 154(b) by 371 days.

(21) Appl. No.: 17/639,104

(22) PCT Filed: Sep. 3, 2020

(86) PCT No.: PCT/NZ2020/050098
§ 371 (c)(1),
(2) Date: Feb. 28, 2022

(87) PCT Pub. No.: WO2021/054843
PCT Pub. Date: Mar. 25, 2021

(65) Prior Publication Data

US 2022/0295957 A1 Sep. 22, 2022

(30) Foreign Application Priority Data

Sep. 18, 2019 (NZ) ..... 757327

(51) Int. Cl.
*A45C 5/14* (2006.01)
*A45C 13/26* (2006.01)

(52) U.S. Cl.
CPC ..... *A45C 5/146* (2013.01); *A45C 13/262* (2013.01)

(58) Field of Classification Search
CPC . A45C 5/146; A45C 13/262; A45C 2005/148; A45C 5/14
See application file for complete search history.

(56) References Cited

U.S. PATENT DOCUMENTS 5,568,848 A * 10/1996 Liang ..... A45C 5/14 190/18 R
10,130,150 B2 * 11/2018 Barenbrug ..... A45C 13/04
2001/0045715 A1 11/2001 Abraham et al.
(Continued)

FOREIGN PATENT DOCUMENTS

CN 2712138 Y 7/2005
CN 203581041 U 5/2014
(Continued)

OTHER PUBLICATIONS

DE-10050783-A1 translation (Year: 2002).*
(Continued)

*Primary Examiner* — Don M Anderson
*Assistant Examiner* — Justin Caudill
(74) *Attorney, Agent, or Firm* — Holzer Patel Drennan

(57) ABSTRACT

A luggage apparatus and method is described herein that introduce a separate wheeled sub-frame that mounts on the base of a luggage apparatus and which allows for dual mode use between an upright mode and a tilt mode. The geometry of the relationship between the bag frame and sub-frame of the luggage apparatus urges the bag to tilt and return upright. The luggage apparatus is securely supported about the sub-frame in both modes with a changing centre of gravity and can be pushed or pulled in either mode.

20 Claims, 13 Drawing Sheets

(56) References Cited

U.S. PATENT DOCUMENTS

| | | | | |
|---|---|---|---|---|
| 2004/0216970 | A1 | 11/2004 | Sherrell et al. | |
| 2008/0223679 | A1* | 9/2008 | Wong | A45C 13/385 190/18 A |
| 2009/0057082 | A1* | 3/2009 | Mize | A45C 13/262 190/18 R |
| 2012/0161408 | A1 | 6/2012 | Sidhu | |
| 2014/0345996 | A1 | 11/2014 | Haramaty et al. | |
| 2015/0075933 | A1* | 3/2015 | Clarke | A45C 13/28 190/8 |
| 2015/0245694 | A1* | 9/2015 | Banoun | A45C 5/14 190/18 A |
| 2019/0298022 | A1* | 10/2019 | Shechter | A45C 5/14 |
| 2020/0000192 | A1 | 1/2020 | Kim et al. | |

FOREIGN PATENT DOCUMENTS

| | | | |
|---|---|---|---|
| CN | 109156952 | A | 1/2019 |
| DE | 10050783 | A1 | 5/2002 |
| TW | 415182 | U | 12/2000 |
| WO | 2018174519 | A1 | 9/2018 |

OTHER PUBLICATIONS

National Intellectual Property Administration, RPC, Office Action issued in corresponding foreign application No. 2020800659455.
National Intellectual Property Administration, RPC, Search Report issued in corresponding foreign application No. 2020800659455.
European Patent Office, European Search Report, dated Sep. 18, 2023, from corresponding European application No. 20864565.5.

* cited by examiner

MULTI-MODE LUGGAGE APPARATUS AND METHOD

TECHNICAL FIELD

Described herein is a multi-mode luggage apparatus and method. The luggage apparatus moves between upright and tilt modes providing a stable platform in both modes.

BACKGROUND ART

Traditional luggage bags are either single configuration i.e. fixed wheels on the luggage base—two or four—drag bag or upright four wheel bag. User tips the bag and drags on two wheels (hence term drag bag). Alternately, bag sits on four wheels and is pushed along or tipped onto two wheels and dragged.

One development is bags that are like above but reconfigurable to locate and carry a load on the portion between the bag top and extended handle height (typically a child or smaller suitcase or bag). In these circumstances, it may be useful to help support the bag in a reclined position particularly given the added weight about the top of the bag/handle region. Without support the offset/amended centre of gravity may cause the baggage to tip over or at least be heavy for the user to hold the handle due to a higher centre of gravity imposing force on the handle as well as the wheels.

Art dual mode bags integrate transition mechanisms into the bag frame. In most embodiments, the bag typically includes two wheels mounted on or about the suitcase rear (the side where the handle extends from). Hinging from the bag rear are two additional wheels that hinge out when a child carrying mode is desired. For example, CN202874103 uses a wheel support system that hinges from the bag top to form an A-frame shape when deployed and looking side on. This is essentially a single axis of rotation assembly and deploying the rear wheels is independent to bag tilting i.e. mode change does not urge luggage tilt/upright movement.

Integral to the A-frame shape is a telescoping handle that moves up and down relative to the suitcase rear. The bag is titled on an angle to rest on the extended rear legs and provides a four wheel base for the bag and a child or bag carried on the bag is more securely held in place. These art dual configuration bags are however not ideal. For example, the user cannot roll the bag when in an upright configuration unlike a traditional four wheeled suitcase. They can only be used when not in a child carrying mode in drag bag style. Further, art systems like the above require considerable tooling and materials leading to more expensive and complex final products. Further, because the child carrying configuration components like additional wheels, struts and structural members are nested with or are about the bag when not in a child carrying mode, carrying space inside the bag is compromised as the child carrying parts often protrude into the bag cavity.

Further aspects and advantages of the multi-configuration luggage will become apparent from the ensuing description that is given by way of example only.

SUMMARY

A luggage apparatus and method is described herein that introduce a separate wheeled sub-frame that mounts on the base of a luggage apparatus and which allows for dual mode use between an upright mode and a tilt mode. The geometry of the relationship between the bag frame and sub-frame of the luggage apparatus urges the bag to tilt and return upright.

The luggage apparatus is securely supported about the sub-frame in both modes with a changing centre of gravity and can be pushed or pulled in either mode.

In a first aspect there is provided a luggage apparatus comprising a bag frame and sub-frame, the luggage apparatus configured to move between an upright mode with the bag frame in a substantially upright orientation and a tilt mode with the bag frame on an angle relative to a vertical plane, the sub-frame shape elongated and retracted to move the bag frame between the upright mode and tilt mode.

In a second aspect, there is provided a luggage apparatus comprising a bag frame and sub-frame, the luggage apparatus configured to move between an upright mode with the bag frame in a substantially upright orientation and a tilt mode with the bag frame on an angle relative to a vertical plane, the sub-frame and bag frame geometry defined by three pivot axes, rotation about the three pivot axes moving the bag frame between the upright mode and tilt modes.

In a third aspect there is provided a luggage apparatus comprising a bag frame and a sub-frame, the sub-frame located below the bag frame, the luggage apparatus configured to move between an upright mode with the bag frame in a substantially upright orientation and a tilt mode with the bag frame on an angle relative to a vertical plane, wherein, in upright mode, the luggage apparatus centre of gravity is generally inside a volume defined by the bag frame and wherein, in tilt mode, the luggage apparatus centre of gravity is generally outside a volume defined by the bag frame.

In a fourth aspect there is provided a luggage apparatus comprising a bag frame and a sub-frame, the sub-frame located below the bag frame, the luggage apparatus configured to move between an upright mode with the bag frame in a substantially upright orientation and a tilt mode with the bag frame on an angle relative to a vertical plane, wherein, when the luggage apparatus is moved from an upright mode to a tilt mode, the luggage apparatus centre of gravity moves backwards and when the luggage apparatus moves from a tilt mode to an upright mode, the centre of gravity moves forwards.

In a fifth aspect there is provided a method of configuring a luggage apparatus between an upright mode and tilt mode, the method comprising the steps of:

- providing a luggage apparatus substantially as described above;
- extending the sub-frame from a retracted position to an elongated position and in doing so, urging the bag frame to tilt to a tilt mode position; and optionally,
- retracting the sub-frame from an elongated position to a retracted position and in doing so, urging the bag frame to an upright mode position.

The multi-mode luggage apparatus and method provide a variety of benefits including a reduced number of parts leading to lower complexity and cost, urging action between modes, strength and stability and an increased bag body volume through avoiding parts of the bag frame and sub-frame intruding into the bag body volume.

BRIEF DESCRIPTION OF THE DRAWINGS

Further aspects of the multi-mode luggage apparatus and method will become apparent from the following description that is given by way of example only and with reference to the accompanying drawings in which.

DETAILED DESCRIPTION

As noted above, luggage apparatus and method described herein introduce a separate wheeled sub-frame that mounts on the base of a luggage apparatus and which allows for dual mode use between an upright mode and a tilt mode. The geometry of the relationship between the bag frame and sub-frame of the luggage apparatus urges the bag to tilt and return upright. The luggage apparatus is securely supported about the sub-frame in both modes and can be pushed or pulled in either mode.

For the purposes of this specification, the term 'about' or 'approximately' and grammatical variations thereof mean a quantity, level, degree, value, number, frequency, percentage, dimension, size, amount, weight or length that varies by as much as 30, 25, 20, 15, 10, 9, 8, 7, 6, 5, 4, 3, 2, or 1% to a reference quantity, level, degree, value, number, frequency, percentage, dimension, size, amount, weight or length.

The term 'substantially' or grammatical variations thereof refers to at least about 50%, for example 75%, 85%, 95% or 98%.

The term 'comprise' and grammatical variations thereof shall have an inclusive meaning—i.e. that it will be taken to mean an inclusion of not only the listed components it directly references, but also other non-specified components or elements.

Figure 1:
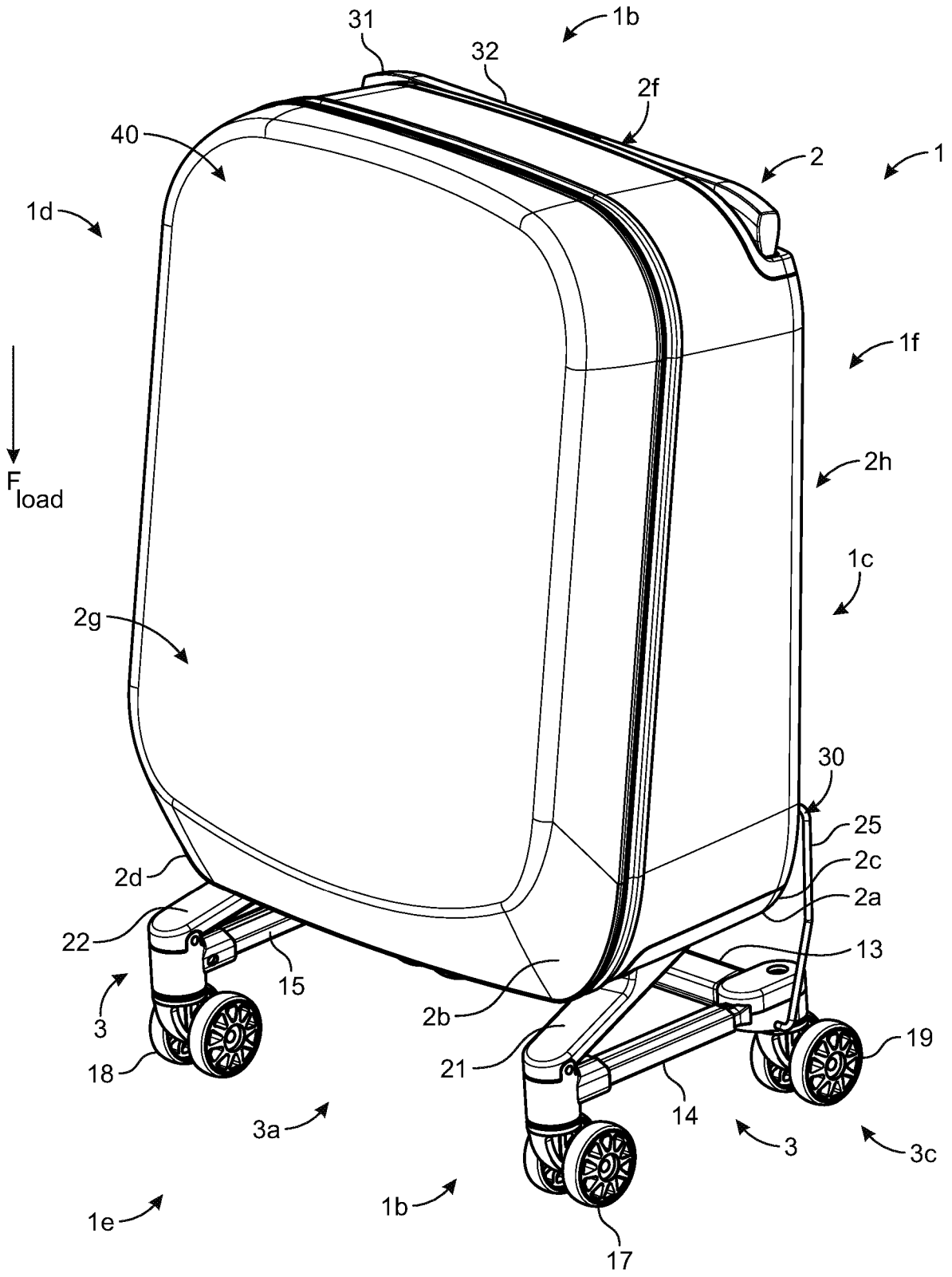
FIG. 1 illustrates a front perspective view of a multi-mode luggage apparatus in an upright mode.
Figure 2:
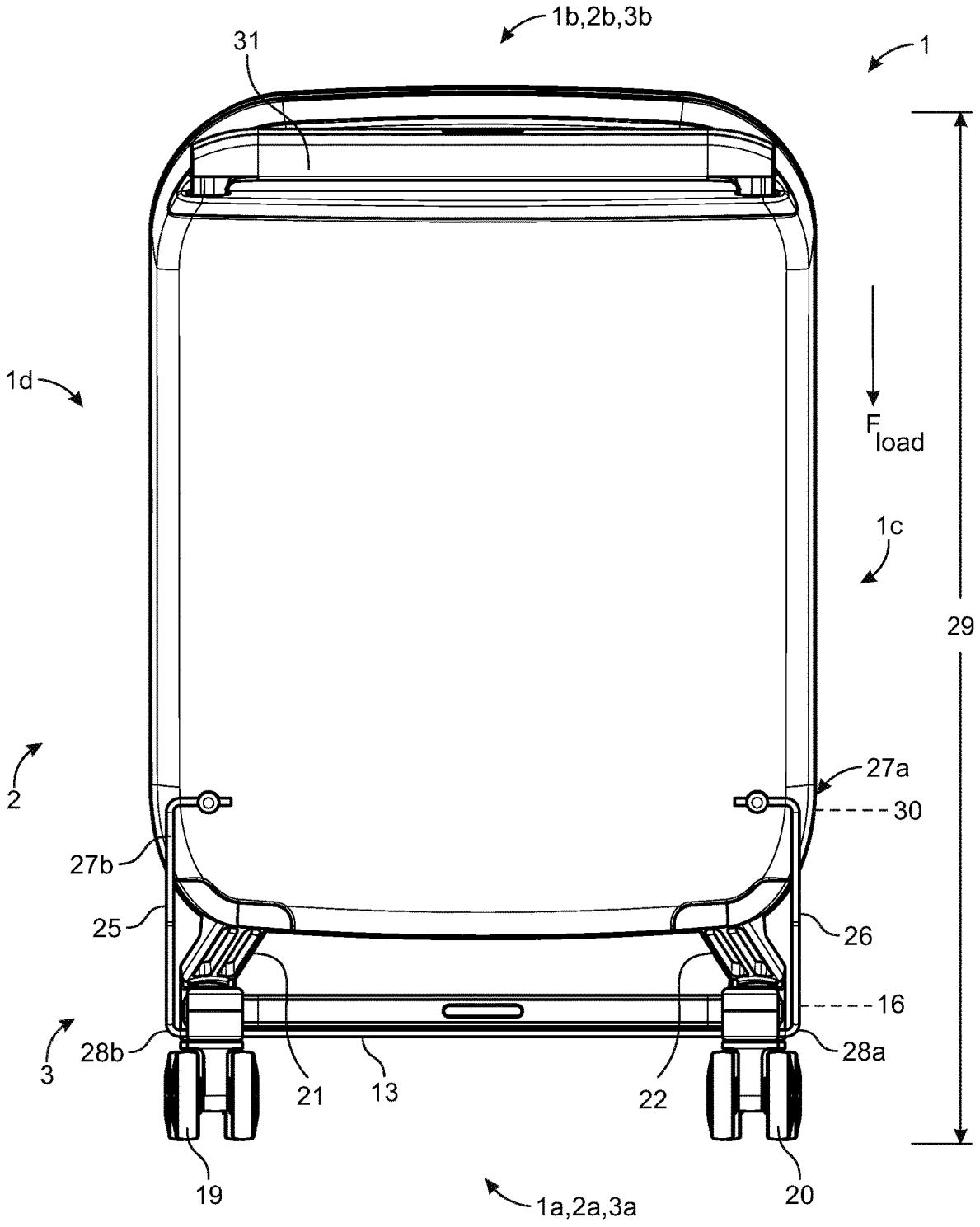
FIG. 2 illustrates a rear elevation view of the apparatus in in an upright mode.
Figure 3:
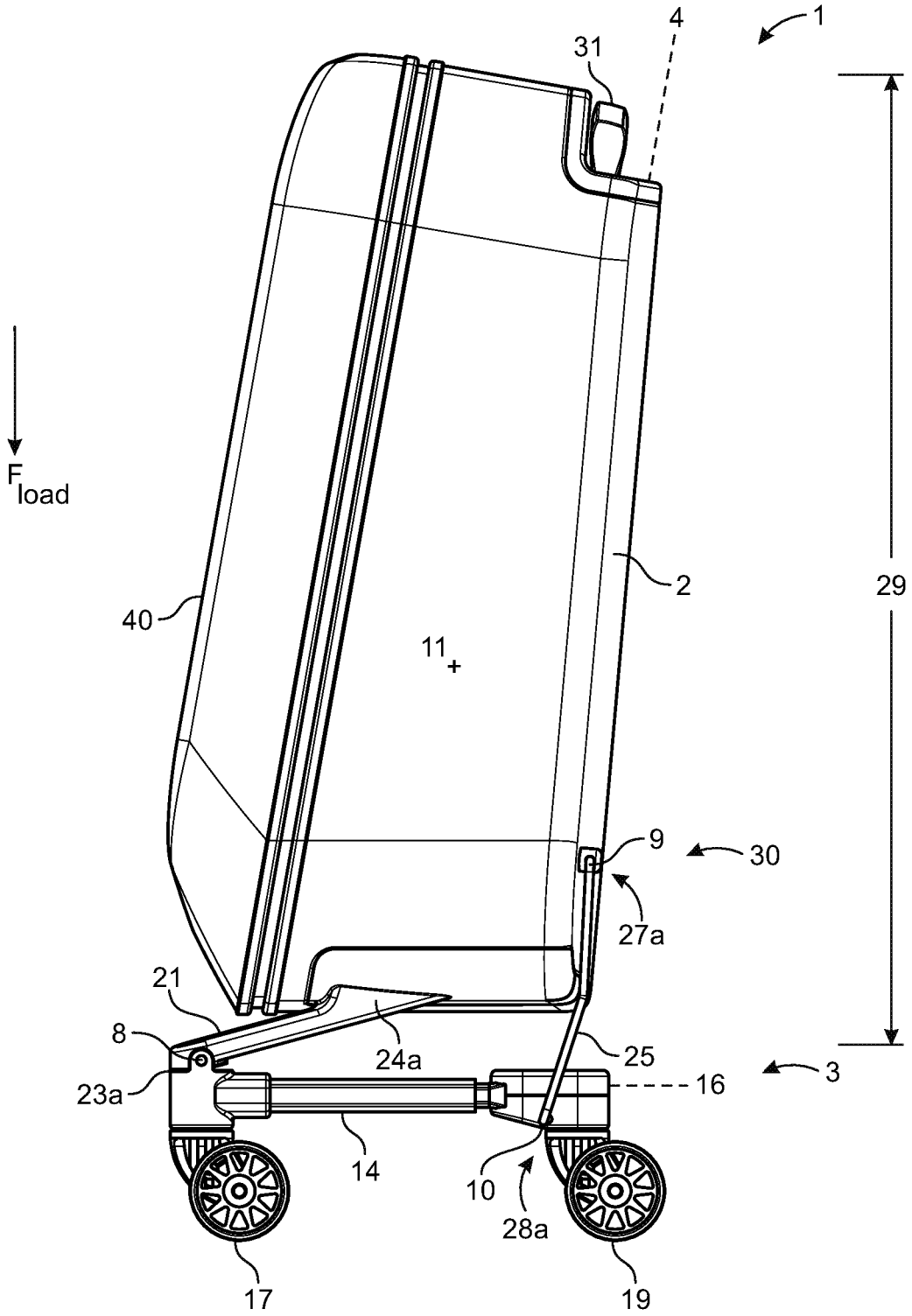
FIG. 3 illustrates a side elevation view of the apparatus in in an upright mode.
Figure 4:
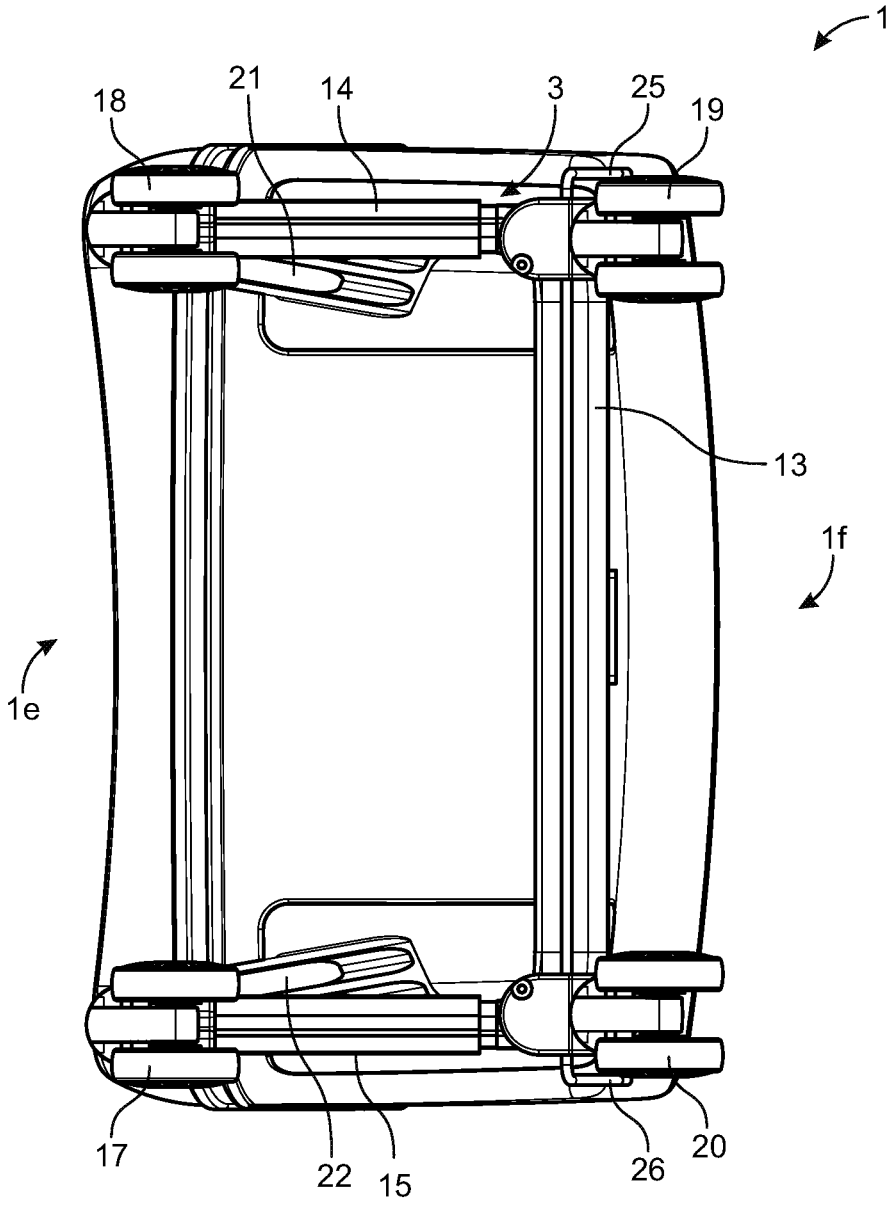
FIG. 4 illustrates the underside of the apparatus in an upright mode.
Figure 5:
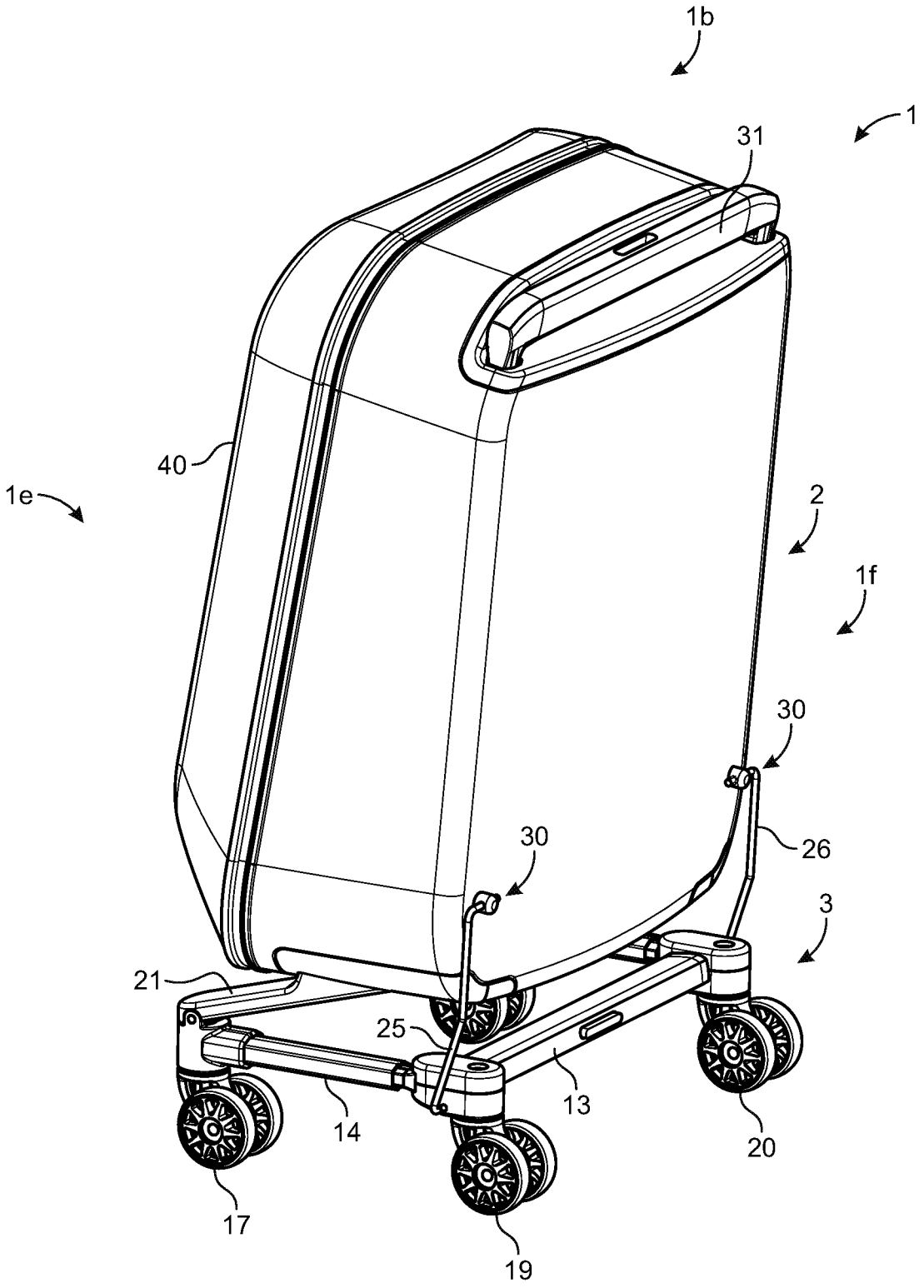
FIG. 5 illustrates a rear perspective view of the apparatus in an upright mode.
Figure 6:
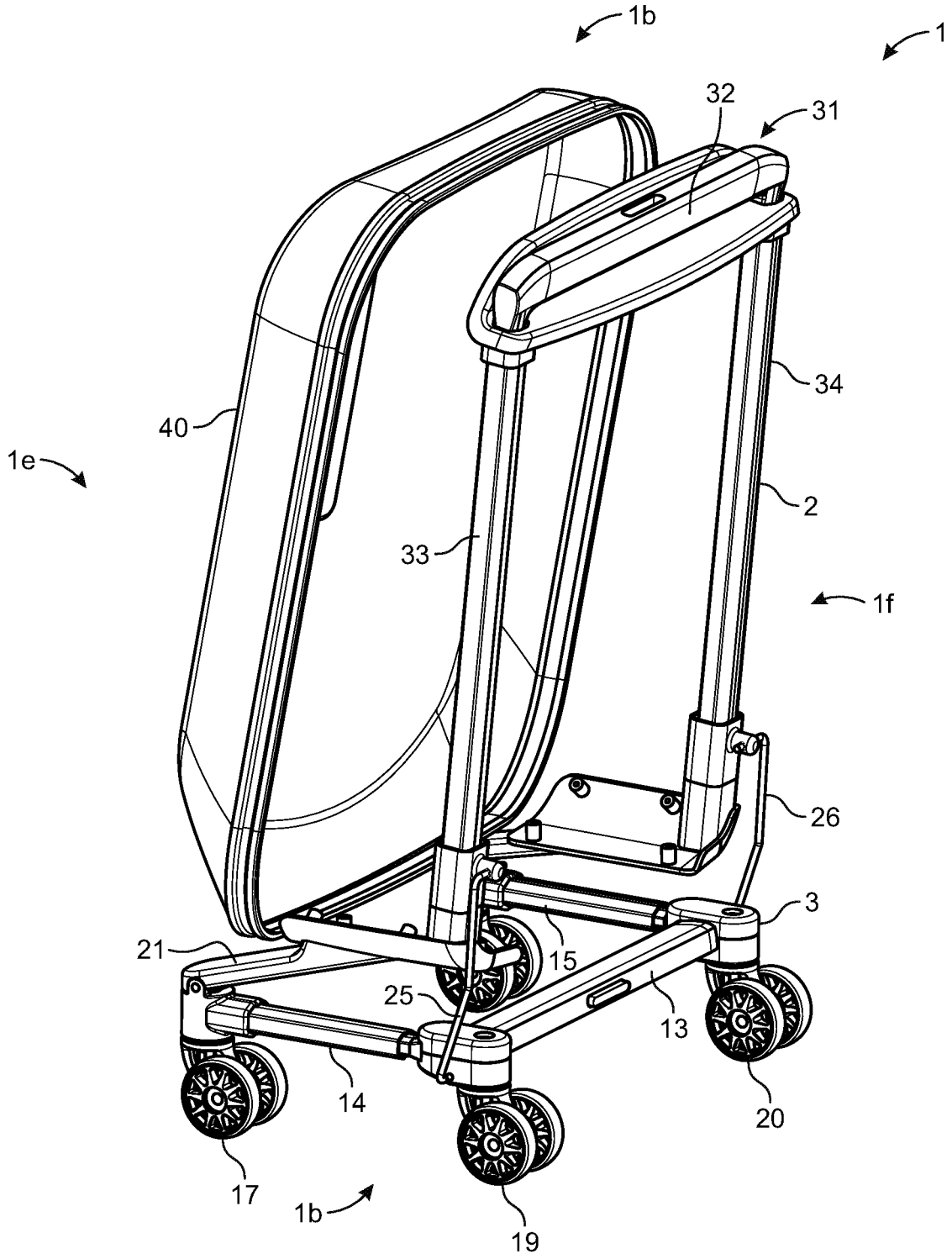
FIG. 6 illustrates a rear perspective view of the apparatus with the bag body removed to illustrate the bag frame and sub-frame in more detail, the apparatus being in an upright mode.
Figure 7:
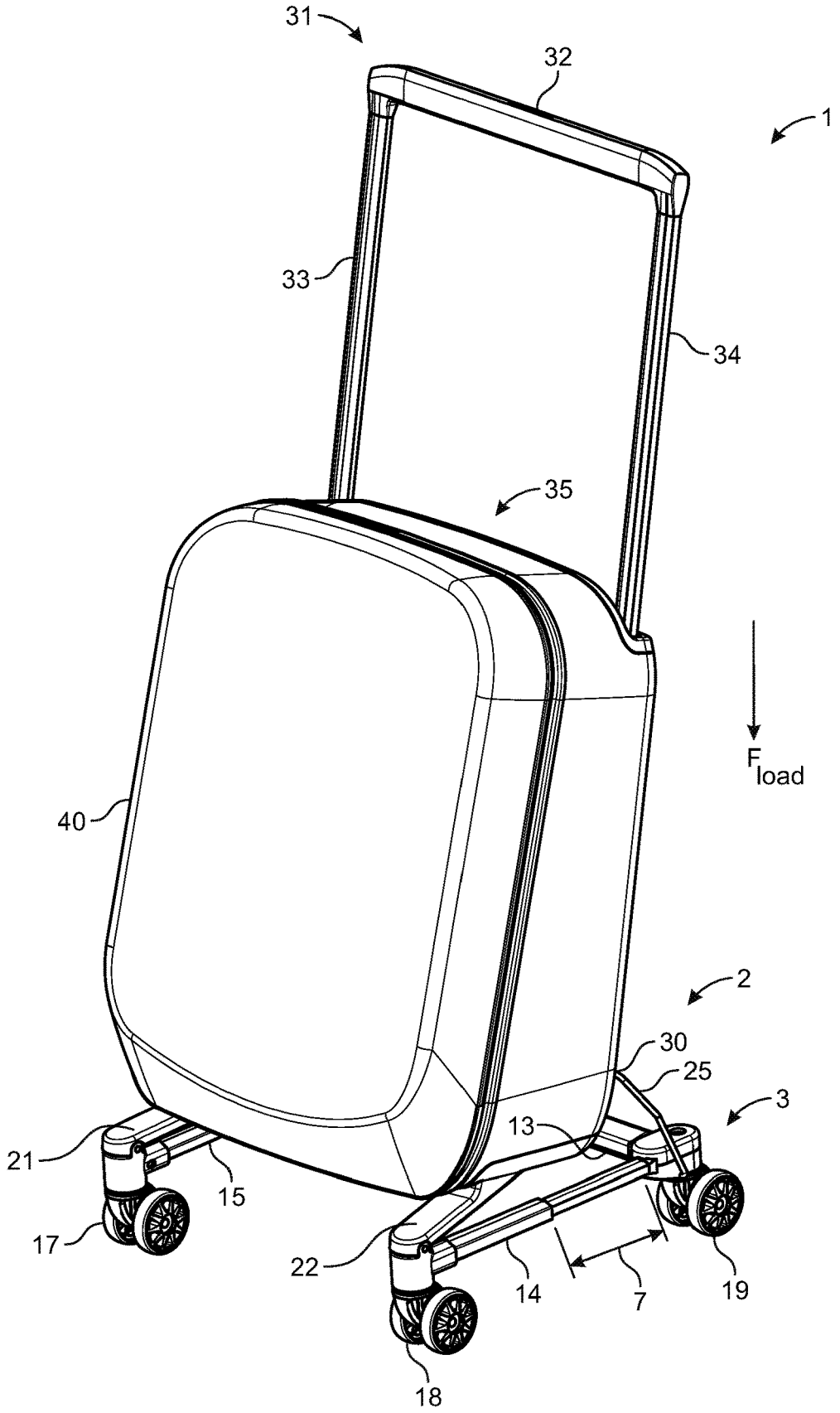
FIG. 7 illustrates a front perspective view of the apparatus in a tilt configuration.
Figure 8:
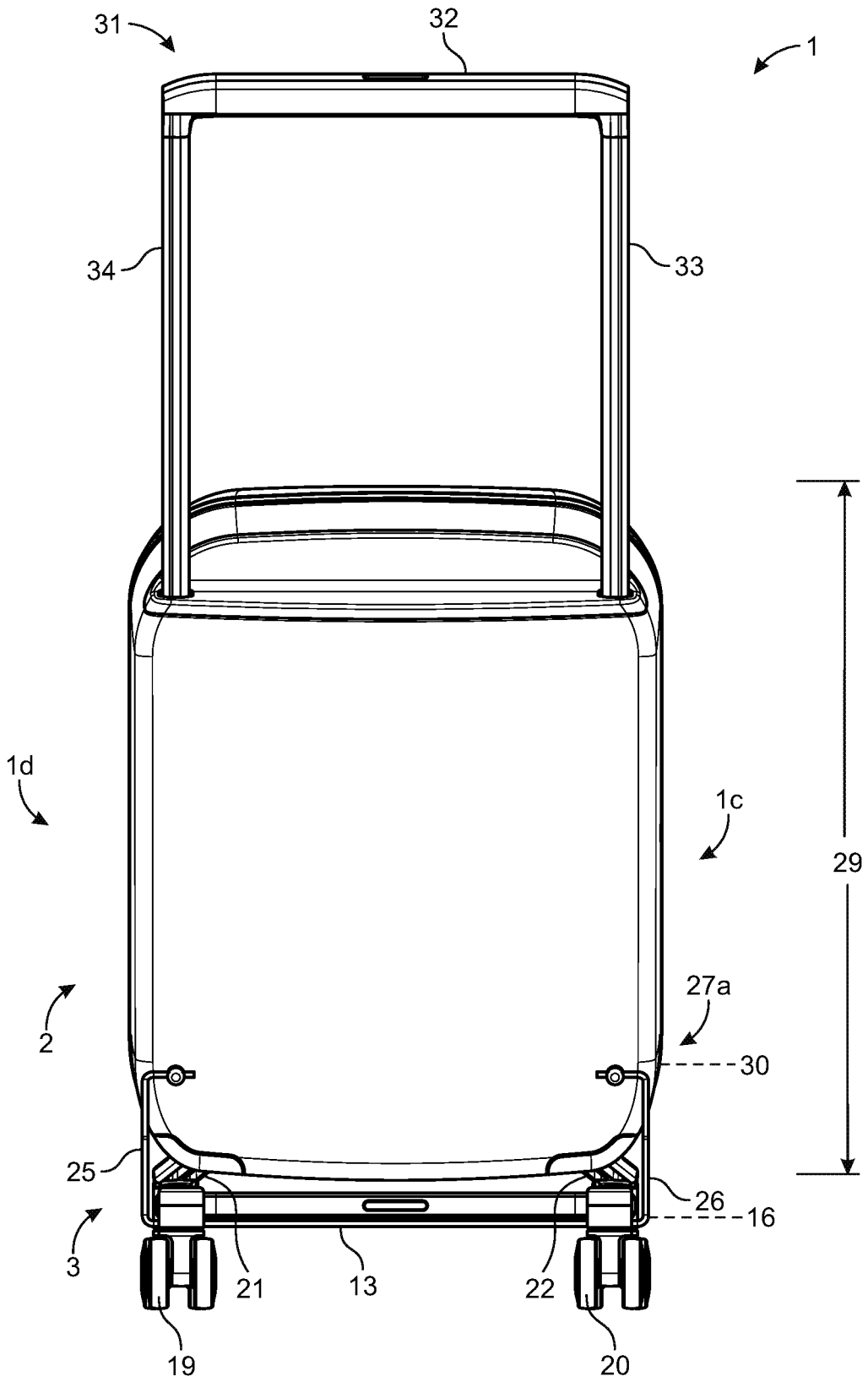
FIG. 8 illustrates a rear elevation view of the apparatus in a tilt configuration.
Figure 9:
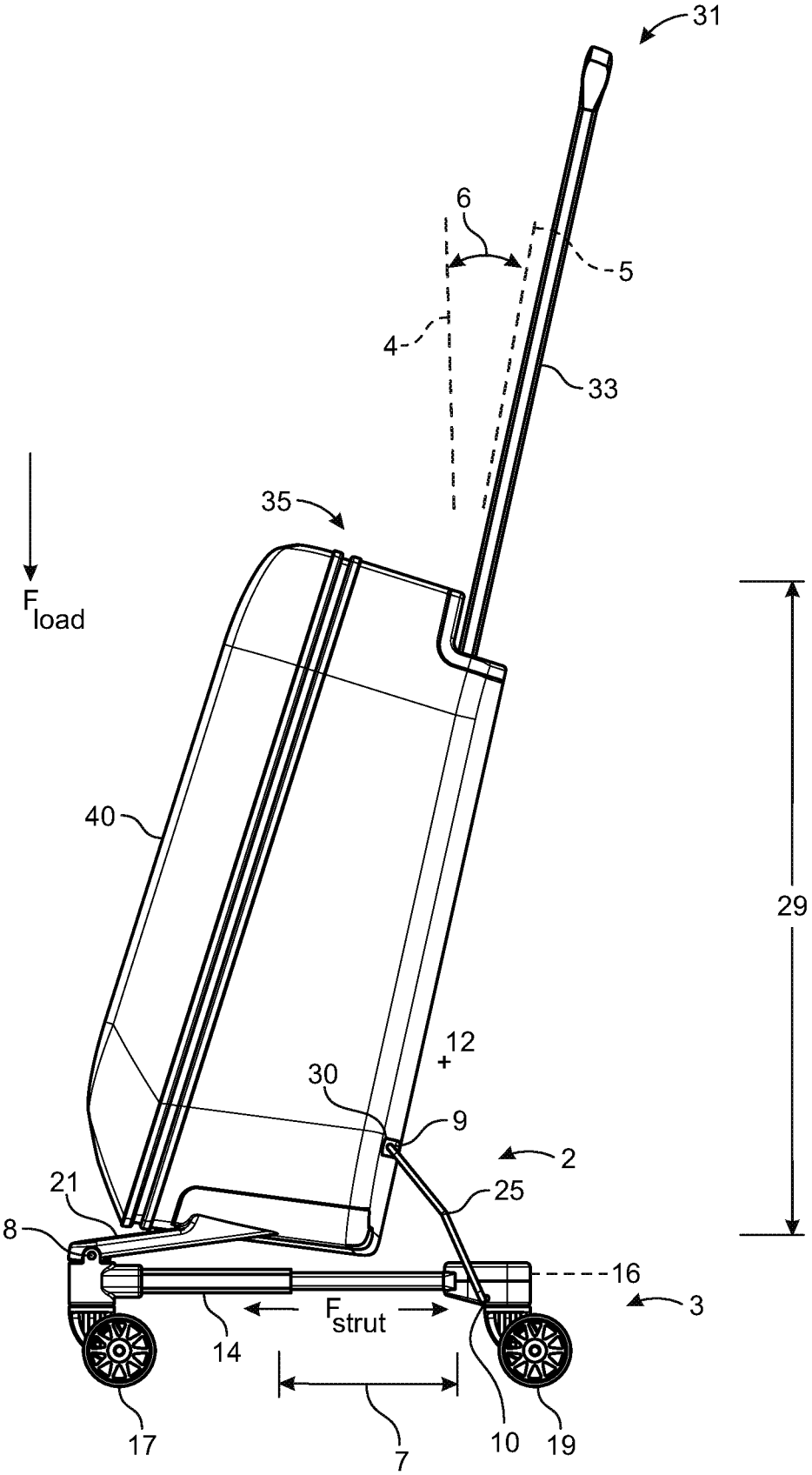
FIG. 9 illustrates a side elevation view of the apparatus in a tilt configuration.
Figure 10:
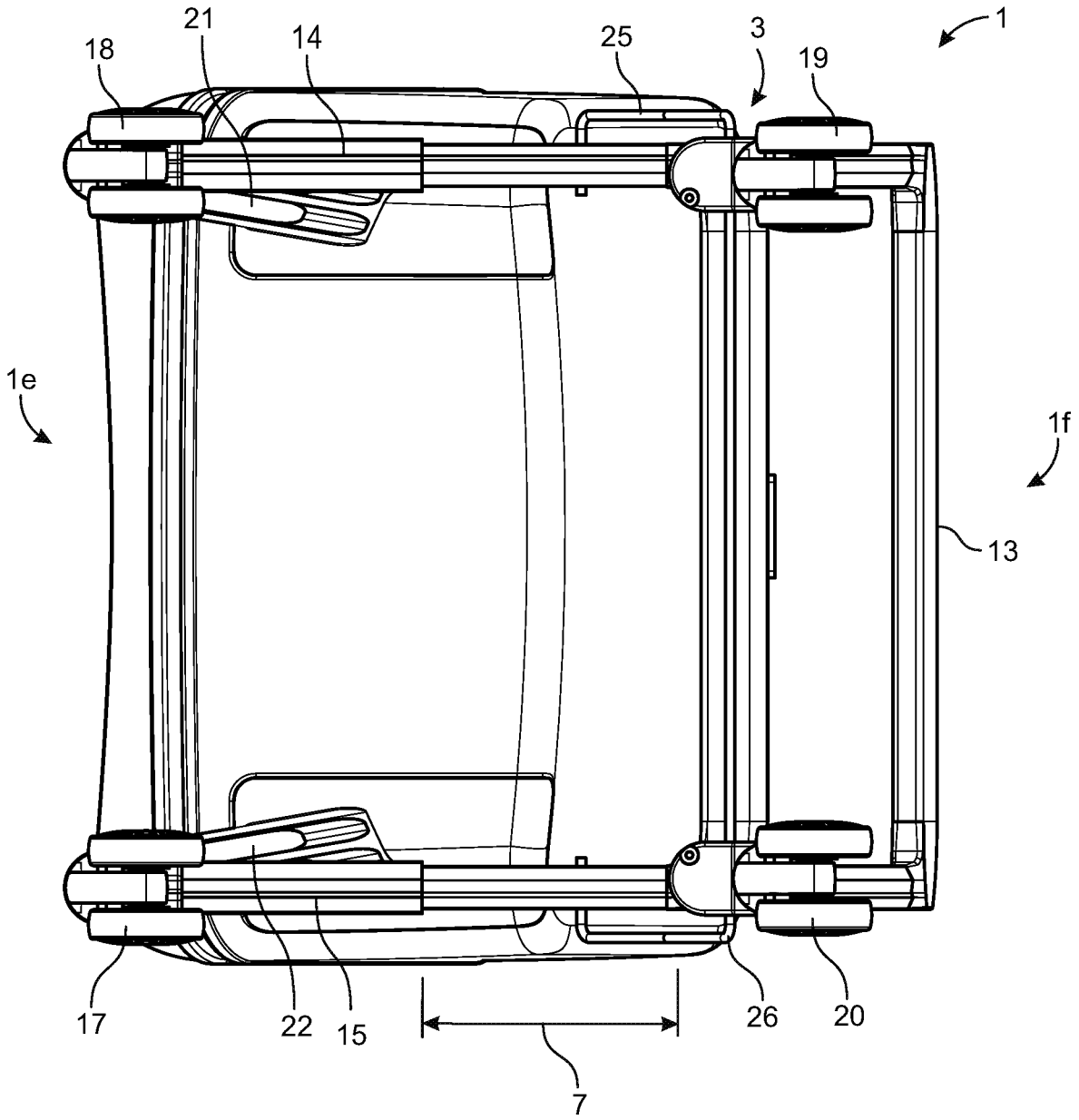
FIG. 10 illustrates an underside elevation view of the apparatus in a tilt configuration.
Figure 11:
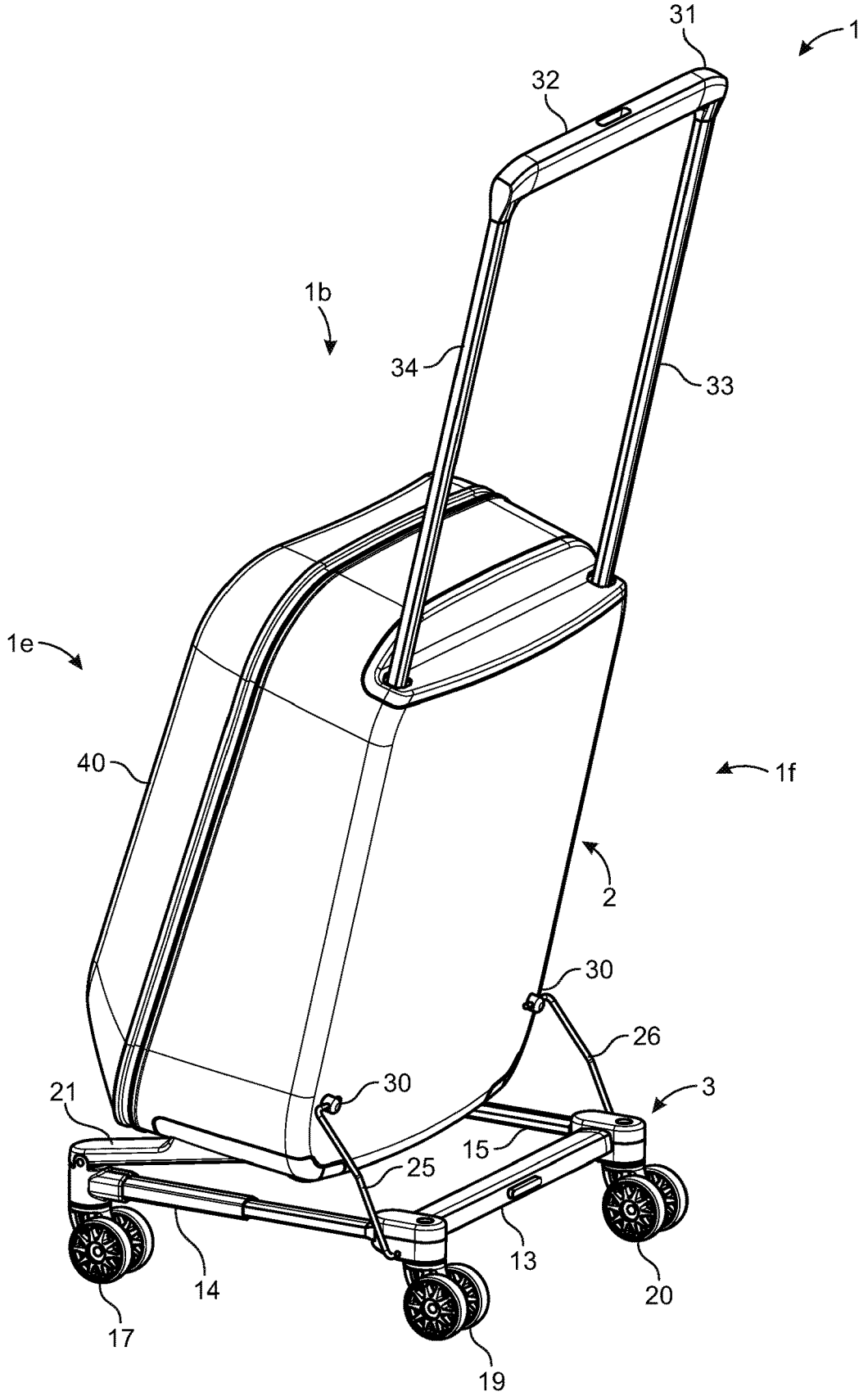
FIG. 11 illustrates a rear perspective view of the apparatus in a tilt configuration.
Figure 12:
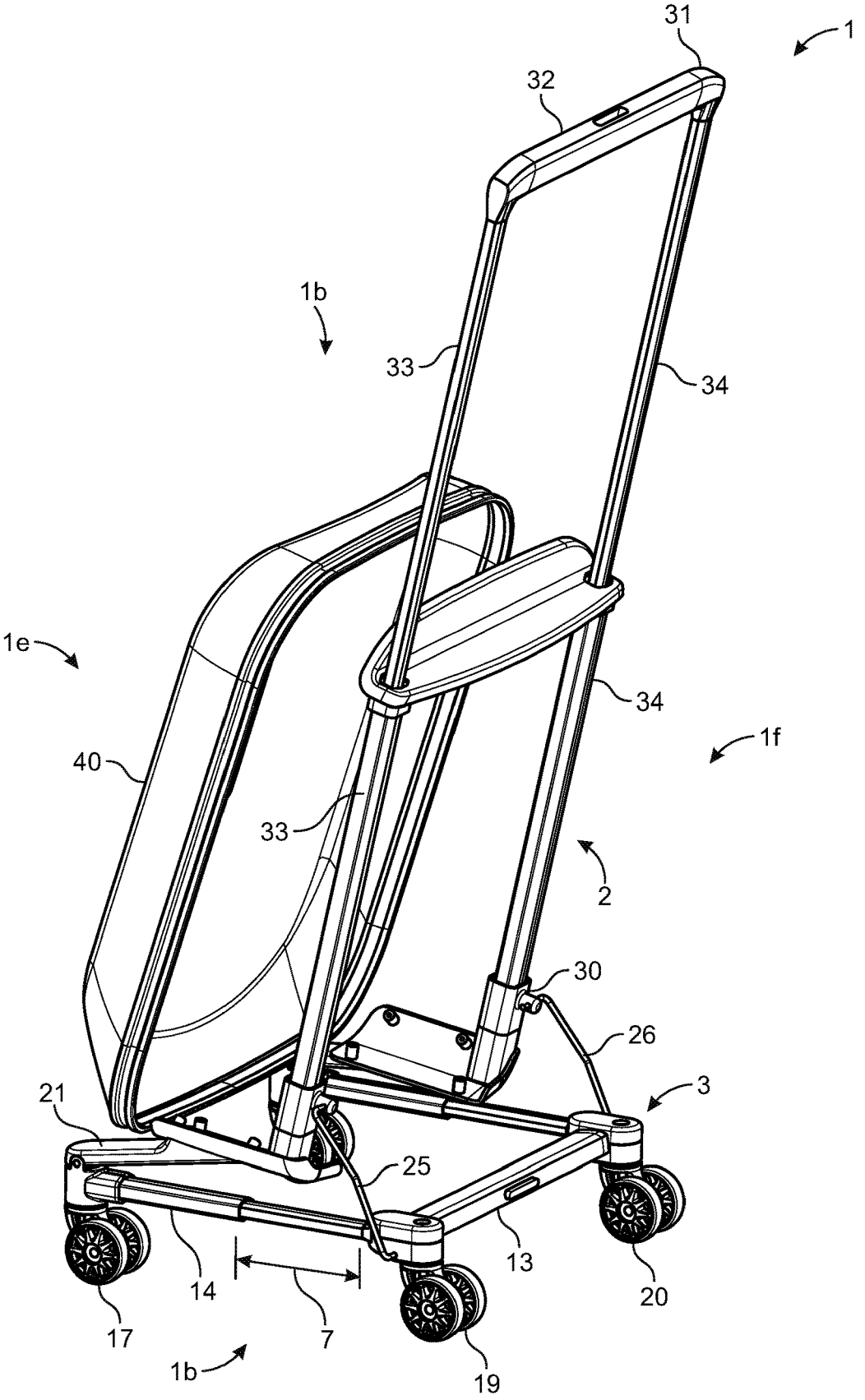
FIG. 12 illustrates a rear perspective view of the apparatus in a tilt configuration with the bag body removed to illustrate the bag frame and sub-frame in more detail.

For clarity and ease of description the terms front, rear, top, base or bottom, side or sides and ground are referred to. These terms reflect a 'normal' position of use of the luggage apparatus with the luggage apparatus conveyed over ground or a surface such as a floor. Rear refers to a handle location of the luggage generally held and pushed or dragged by a user. Front refers to the opposing side of the rear. The front and rear of the luggage are generally wider in width than the luggage apparatus sides. The term side or sides refer to the edges of the luggage apparatus usually at right angles to the direction of travel of the luggage apparatus when conveyed over a surface. The term top refers to the upper most surface of the item described furthest away from the ground or surface on which the luggage apparatus is conveyed. The term base or bottom refers to the surface of the item described closest to the ground or surface on which the luggage apparatus is conveyed. For example, using FIGS. 1-12 as a reference, the luggage apparatus 1 comprises a bag frame 2 with a base 2*a*, top 2*b*, sides 2*c*, 2*d*, front 2*e* and rear 2*f*. The luggage apparatus further comprises a sub-frame 3 with a sub-frame base 3*a*, top 3*b*, sides 3*c*, 3*d*, front 3*e* and rear 3*f*.

Luggage Apparatus Generally

In a first aspect there is provided a luggage apparatus comprising a bag frame and sub-frame, the luggage apparatus configured to move between an upright mode with the bag frame in a substantially upright orientation and a tilt mode with the bag frame on an angle relative to a vertical plane, the sub-frame shape elongated and retracted to move the bag frame between the upright mode and tilt mode.

In a second aspect, there is provided a luggage apparatus comprising a bag frame and sub-frame, the luggage apparatus configured to move between an upright mode with the bag frame in a substantially upright orientation and a tilt mode with the bag frame on an angle relative to a vertical plane, the sub-frame and bag frame geometry defined by three pivot axes, rotation about the three pivot axes moving the bag frame between the upright mode and tilt modes.

In a third aspect there is provided a luggage apparatus comprising a bag frame and a sub-frame, the sub-frame located below the bag frame, the luggage apparatus configured to move between an upright mode with the bag frame in a substantially upright orientation and a tilt mode with the bag frame on an angle relative to a vertical plane, wherein, in upright mode, the luggage apparatus centre of gravity is generally inside a volume defined by the bag frame and wherein, in tilt mode, the luggage apparatus centre of gravity is generally outside a volume defined by the bag frame.

In a fourth aspect there is provided a luggage apparatus comprising a bag frame and a sub-frame, the sub-frame located below the bag frame, the luggage apparatus configured to move between an upright mode with the bag frame in a substantially upright orientation and a tilt mode with the bag frame on an angle relative to a vertical plane, wherein, when the luggage apparatus is moved from an upright mode to a tilt mode, the luggage apparatus centre of gravity moves backwards and when the luggage apparatus moves from a tilt mode to an upright mode, the centre of gravity moves forwards.

Figure 13:
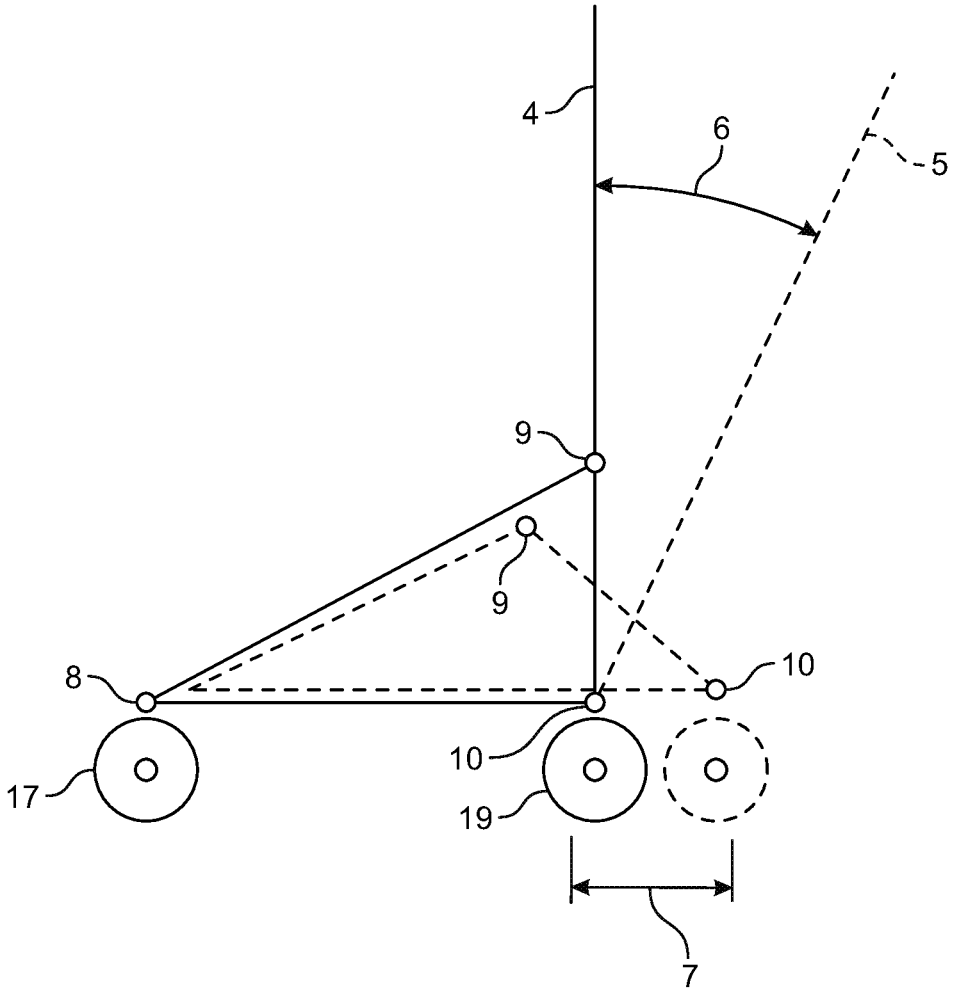
FIG. 13 illustrates a schematic side view of the pivot point geometry with an upright mode compared to a tilt mode position.

Referring to FIGS. 1-13, by way of example, the luggage apparatus 1 comprises a bag frame 2 and sub-frame 3, the luggage apparatus 1 configured to move between an upright mode (shown in FIGS. 1-6) with the bag frame 2 in a substantially upright orientation and a tilt mode (shown in FIGS. 7-12) with the bag frame 2 angled along line 5 and angle 6 relative to a vertical plane drawn as line 4. The sub-frame 3 shape may be elongated and retracted to move the bag frame 2 between the upright mode and tilt mode. The sub-frame 3 and bag frame 2 geometry maybe defined by three pivot axes 8, 9, 10, rotation about the three pivot axes 8, 9, 10 moving the bag frame 2 between the upright mode and tilt mode. The sub-frame 3 may be located below the bag frame 2. In upright mode, the luggage apparatus 1 centre of gravity 11 is generally inside a volume defined by the bag frame 2 and wherein, in tilt mode, the luggage apparatus 1 centre of gravity 12 is generally outside a volume defined by the bag frame 2. As shown in the Figures, the centre or gravity 11, 12 in an upright mode (FIGS. 1-6) moves backward when the luggage apparatus 1 shifts to a tilt mode (FIGS. 7-12) and moves forwards when the luggage apparatus 1 moves to an upright mode. Movement backwards or forwards may be at least somewhat in concert with sub-frame elongation and retraction.

Pivot Axes

As noted above, the sub-frame and bag frame geometry may be defined by three pivot axes, rotation about the three pivot axes 8, 9, 10 moving the bag frame between the upright mode and tilt modes. The three pivot axes 8, 9, 10 may define a generally triangular shape best seen in the schematic of FIG. 13. The triangular shape formed by the pivot axes 8, 9, 10 is an approximately right angle shape (solid line triangle) when the luggage apparatus 1 is in an upright mode. The triangular shape formed by the pivot axes 8, 9, 10 may be an approximately acute angle shape when the luggage apparatus 1 is in a tilt mode.

The geometry and pivot points 8, 9, 10 noted above force the bag to tilt when the sub-frame 3 is extended to a tilt mode and forces the bag frame 2 to return to a upright mode when the sub-frame 3 is retracted.

Sub-Frame Generally

As can be seen in the Figures, the sub-frame 3 maybe located below the bag frame 2.

The sub-frame 3 may comprise struts forming the sub-frame 3 structure and has wheels 17, 18, 19, 20 mounted thereon. In the embodiment shown in the Figures, the sub-frame 3 may comprise a rear strut 13 and at least one side struts 14, 15 to form the sub-frame 3 structure. Wheels may be mounted on the sub-frame on which the luggage apparatus may move or be conveyed.

The sub-frame 3 may be configured to extend or elongate when moved to a tilt mode and retract when moved back to an upright mode. This extension/elongation and retraction urges bag frame 2 movement between modes.

Elongation and retraction of the sub-frame 3 occurs to and from a fixed point or axis 8 about the front 2*g* of the bag frame 2 and front 3*g* of the sub-frame 3. The fixed point or axis 8 may be a front pivot axis.

Sub-frame 3 elongation and retraction may in one embodiment occur via at least one sub-frame 3 side strut 14, 15 that extends and retracts. The at least one strut 14, 15 shown in the Figures may extend and retract via telescoping although other elongation/retraction mechanisms may also be used.

The sub-frame 3 shown in the Figures comprises two extending and retracting struts 14, 15, the struts 14, 15 located on either side of the sub-frame 3 generally coincident with each side of the bag frame 2.

The degree of elongation 7 when in a tilt mode of the sub-frame 3 or sub-frame 3 strut(s) 14, 15 is sufficient to allow for a bag frame 2 tilt angle of approximately 5, or 10, or 15, or 20, or 25, or 30, or 35, or 40, or 45 degrees. In one embodiment, the degree of tilt may be 1-45 degrees or 5-30 degrees or 10-30 degrees relative to a vertical plane or upright mode configuration. In one embodiment, in tilt mode, the bag frame may tilt at an angle of 5-45 degrees relative to a vertical plane and, in an upright mode, the bag frame may be in a substantially vertical plane.

The exact dimensions for elongation may be highly variable depending on the geometry. By way of illustration, in embodiments envisaged by the inventor, the degree of elongation 7 of the sub-frame 3 from a upright mode to a tilt mode may be at least 10, or 15, or 20, or 25, or 30, or 35, or 40, or 45, or 50, or 75, or 100, or 125, or 150, or 175, or 200, or 225, or 250, or 275, or 300 mm. In one embodiment, the degree of elongation 7 may be at least 10-300 mm, or 50-300 mm, or 100-200 mm.

The sub-frame 3 may be configured to have a generally planar shape and may lie in an approximately horizontal plane shown by dotted line 16.

The sub-frame 3 may comprise at least three wheels, at least one wheel forward or rear of the other wheels to provide a platform on which the sub-frame and bag frame thereon rest. In the embodiment shown in FIGS. 1-12, the luggage apparatus 1 comprises four wheels 17, 18, 19, 20. All wheels associated with the luggage apparatus 1 may be mounted on the sub-frame 3 and not directly connected or associated with the bag frame 2.

In upright mode, the rear wheel(s) 19, 20 of the sub-frame 3 may be retracted towards the front wheel(s) 17, 18 of the sub-frame 3. In this embodiment and mode, the wheels 17, 18, 19, 20 may be located generally about the bag frame 2 base corners 2*b*, 2*c*, 2*d*, 2*e*, the luggage apparatus 1 centre of gravity 11 being generally inside the bag frame 2.

In a tilt mode, the sub-frame 3 is extended in a generally horizontal plane 16 with the rear wheel(s) 19, 20 of the sub-frame 3 extended away from the front wheel(s) 17, 18 to define a relatively larger separation or elongation distance 7 between the front 17, 18 and rear wheel(s) 19, 20. In this position, the rear wheels 19, 20 may be located generally beyond the bag frame 2 base corners, the luggage apparatus 1 centre of gravity 12 being generally outside the bag frame 2. Expressed another way, in tilt mode, the extended sub-frame and rear wheels 19, 20 thereon are located beyond a region bound by the bag frame 2 base 1*a*.

The sub-frame 3 may be releasably locked in a upright mode and/or a tilt mode. Locking may be via latching (not shown) built into the sub-frame 3 telescoping elements 14, 15.

Tilt

The extent of tilt angle 6 of the bag frame 2 when moved to a tilt mode is dependent on the geometry of the connection between the bag frame 2 and sub-frame 3. This may in turn be defined by the pivot point locations 8, 9, 10 between the bag frame 2 and sub-frame 3 and the extent of extension/elongation of the sub-frame 3.

For example, pivot point placement may allow the bag frame to tilt by approximately 1, or 2, or 3, or 4, or 5, or 10, or 15, or 20, or 25, or 30, or 35, or 40, or 45 degrees relative to a vertical plane or upright mode configuration. In one embodiment, the degree of tilt may be 1-45 degrees or 5-30 degrees or 10-30 degrees relative to a vertical plane or upright mode configuration.

As should be appreciated, the luggage apparatus in a upright mode will have a smaller or shorter footprint than the luggage apparatus in a tilt mode. Despite this, the overall foot print in a tilt mode is comparable or smaller than art luggage apparatus using a side mounting hinged rear wheel assembly.

Sub-Frame Front Link Member

The sub-frame attaches to the bag frame via at least one front link member, the, or each, front link member having an elongated shape with opposing ends.

Using the embodiment of FIGS. 1-13 by way of example, the sub-frame 3 may be linked to the bag frame 2 via two distal horizontally spaced front link members 21, 22. The front link members 21, 22 are located about each side of the bag frame 2 and sub-frame 3.

One end of the at least one front link member attaches to the bag frame generally about the front of the bag frame and an opposing end attaches to the sub-frame generally about the front of the sub-frame.

Front Pivot Axis

The, or each, front link member comprises a pivot axis about the sub-frame attachment point. The pivot axis allows rotational movement between the bag frame and sub-frame about a vertical plane.

The pivot axis may be located generally about or slightly forwards of the bag frame front. The pivot axis may be located generally over a wheel or wheels attached to the sub-frame.

The, or each, front link member may be rigidly attached to the bag frame.

Alternatively, the, or each, front link member comprises a pivot axis about the bag frame attachment point. In this embodiment, the pivot axis still allows rotational movement between the bag frame and sub-frame about a vertical plane. In this embodiment, the, or each, front link member may be rigidly attached to the sub-frame.

Rear Member and Rear Pivot Axes

The sub-frame may attach to the rear of the bag frame via at least one rear member that bridges the sub-frame to the rear of the bag frame.

Using the embodiment shown in FIGS. 1-13 by way of example, the rear 1*f* of the luggage apparatus 1 may comprise two pivot axes 9, 10, the axes 9, 10 being at either end of the at least one rear member 25, 26. Two rear members 25, 26 are used, each one located on each side of the rear 1*f* of the bag frame 2 and sub-frame 3. The rear member(s) are elongate members with opposing ends. The rear members may be wire arms as illustrated in the Figures.

The rear members 25, 26 may act to stabilise between the bag frame 2 and sub-frame 3 about the rear 1*f* of the luggage apparatus 1. The, or each, rear member is linked about the rear 3*b* of the sub-frame 3 at a point about the rear 2*h* of the bag frame 2.

The rear member(s) may be located flush with the bag frame when the luggage apparatus is in upright mode and the rear member(s) pivot out from the bag frame when in tilt mode. Pivoting out may occur via the top of the rear member(s), the lower end of the rear members moving rotationally away from the bag frame.

The rear member(s) may attach to the bag frame at a point that allows for a bag tilt angle of approximately 5, or 10, or 15, or 20, or 25, or 30, or 35, or 40, or 45 degrees. In one embodiment, the degree of tilt may be 1-45 degrees or 5-30 degrees or 10-30 degrees relative to a vertical plane or upright mode configuration.

In embodiments envisaged by the inventor, the rear member(s) may attach at one end to the bag frame in the lower half of the bag. For example, the rear member(s) may attach to the bag frame at a point 10 or 15 or 20 or 25 or 30 or 35, or 40, or 45 or 50% of the overall bag frame height as measured from the base of the bag frame height. In one embodiment, the rear member(s) may attach to the bag frame at a point 10-50%, or 15-40% or 15-30% of the overall bag frame height as measured from the base of the bag frame height.

Force Loading

Force loading onto the sub-frame from the bag frame and/or a load on the bag frame may be directed to the sub-frame wheels in either the upright mode or tilt mode via the front link members and/or rear members. These force loadings are marked as $F_{load}$ arrows in the Figures.

No or minimal force loading occurs via the extending and retracting struts 14, 15 of the sub-frame 3 located between the front and rear of the sub-frame. Any loading occurring through the extending and retracting struts of the sub-frame when in a tilt mode is a tension force shown as arrows $F_{strut}$.

Bag Body and Bag Frame

The bag frame 2 may comprise a body 40 thereon. The bag body 40 may define a cavity or interior compartment space. This cavity is used for conveying goods or luggage therein.

The bag body 40 cavity may be accessed via zips, fasteners or other closures.

In one embodiment, the luggage apparatus 1 may have overall dimensions of: 19-25 inches high, 15-21 inches wide, and 7-13 inches deep. As should be appreciated however, many different dimensions and form or shape of bag body 40 may be possible.

The luggage apparatus may for example be selected from a suitcase, a briefcase, a computer case, a backpack, a trunk, a tote bag, a chest, and a Gladstone bag.

The bag frame may define the general shape of the luggage apparatus 1. The bag frame and optionally part or all of the bag body may be substantially rigid.

Wheels

The wheels may be multi-directional. For example, the wheels may be castors allowing the wheels to swivel about 360 degrees.

The sub-frame may comprise at least three wheels with at least one wheel offset relative to the other wheels. It is envisaged that most embodiments will use four wheels akin to art upright bags (and as shown in the Figures). However, as should be appreciated, three wheels or more than four wheels could be used and still achieve the described functionality.

The wheels may be generally located at distal points on the sub-frame to spread a load conveyed on the sub-frame as wide as possible. For example, if the luggage apparatus comprises four wheels 17, 18, 19, 20 as shown in the Figures, the wheels may be located about the sub-frame 3 corners 3*e*, 3*f*, 3*g*, and 3*h*. In upright mode, the four wheels noted are located about the sides 1*c*, 1*d* of the luggage apparatus 1.

Handle

The handle may be a pull handle. Using the Figures, the handle is shown as item 31, the handle 31 extending to and from the bag frame 2. The handle 31 may comprise a hand grip 32 and handle members 33, 34 linking the handle 31 and bag frame 2. A single handle member (not shown) could be used but for strength and rigidity two (or more) handle members are likely to be preferable.

The at least one handle member may comprise at least one rod and tube telescopingly mounted to the bag frame.

The handle may be integral to the bag frame and not directly linked to the sub-frame.

The handle when extended may provide vertical structure to allow the bag frame to support a load (an object or child for example) on top 2*b* of the bag frame 2.

The handle position may be independent of the sub-frame and mode. That is, the handle may be extracted and retracted from the bag frame without need to adjust the sub-frame and mode.

The handle may be used to push or pull the luggage apparatus in either upright mode or tilt mode, pushing or pulling conveying the luggage apparatus via the wheels over a surface. Unlike art multi-configuration luggage, the luggage apparatus described herein is not a drag bag style bag and hence can be pushed or pulled over a surface.

Object or Load Carrying

The luggage apparatus bag frame and/or bag body and the handle combine to define a load-bearing section that can receive a load such as a briefcase or a child thereon. Arrow 35 in the Figures defines a region at which a load like a bag or child may be located when the luggage apparatus is in a tilt mode.

Method of Mode Transfer

In a fifth aspect there is provided a method of configuring a luggage apparatus between a upright mode and tilt mode, the method comprising the steps of:

providing a luggage apparatus substantially as described above;

extending the sub-frame from a retracted position to an elongated position and in doing so, urging the bag frame to tilt to a tilt mode position; and optionally, retracting the sub-frame from an elongated position to a retracted position and in doing so, urging the bag frame to an upright mode position.

Referring to FIGS. 1-6, the luggage apparatus is shown in an upright mode. To transfer to a tilt mode, the sub-frame is extending, in the Figures via telescoping side struts. Elongation causes the spacing between the front and rear wheels to elongate and rotation about the pivot axes occurs. As elongation occurs, tilting of the bag frame also occurs until a final tilt mode is reached (the position shown in FIGS. 7-12). The final position may be defined by a stop or locking mechanism. To return the luggage apparatus to an upright position, the reverse process may be undertaken of retracting the sub-frame side struts which in turn causes rotation about the pivot axes and return a bag frame upright mode.

The embodiments described above may also be said broadly to consist in the parts, elements and features referred to or indicated in the specification of the application, individually or collectively, and any or all combinations of any two or more said parts, elements or features.

Further, where specific integers are mentioned herein which have known equivalents in the art to which the embodiments relate, such known equivalents are deemed to be incorporated herein as if individually set forth.

Aspects of the luggage apparatus and method have been described by way of example only and it should be appreciated that modifications and additions may be made thereto without departing from the scope of the claims herein.

What is claimed is:

1. A luggage apparatus comprising a bag frame and sub-frame, the luggage apparatus configured to move between an upright mode with the bag frame in a substantially upright orientation and a tilt mode with the bag frame on an angle relative to a vertical plane, the sub-frame and bag frame geometry defined by only three pivot axes, rotation about the three pivot axes moving the bag frame between the upright mode and tilt modes, wherein the three pivot axes define a generally triangular shape formed by the pivot axes, which are in an approximately right angle shape when the luggage apparatus is in an upright mode and, the triangular shape formed by the pivot axes has an approximately acute angle shape when the luggage apparatus is in a tilt mode.

2. The luggage apparatus as claimed in claim 1 wherein the sub-frame shape elongates and retracts about a generally horizontal plane to move the bag frame between the upright mode and tilt mode.

3. The luggage apparatus as claimed in claim 1 wherein, in upright mode, the luggage apparatus centre of gravity is generally inside a volume defined by the bag frame and wherein, in tilt mode, the luggage apparatus centre of gravity is generally outside a volume defined by the bag frame.

4. The luggage apparatus as claimed in claim 1 wherein elongation and retraction of the sub-frame occurs to and from a fixed point or axis about the front of the bag frame and front of the sub-frame, the fixed point or axis being a front pivot axis.

5. The luggage apparatus as claimed in claim 1 wherein the sub-frame is configured to have a generally planar shape and lies in an approximately horizontal plane and, wherein the sub-frame further comprises a rear strut and at least one side strut to form the sub-frame structure with wheels mounted on the sub-frame on which the luggage apparatus is moved.

6. The luggage apparatus as claimed in claim 5 wherein the sub-frame comprises at least three wheels, at least one wheel forward or rear of the other wheels on which the sub-frame and bag frame move.

7. The luggage apparatus as claimed in claim 6 wherein all wheels are mounted on the sub-frame and not directly connected or associated with the bag frame.

8. The luggage apparatus as claimed in claim 1 wherein, the sub-frame is configured to have a generally planar shape and lies in an approximately horizontal plane and, wherein the sub-frame further comprises a rear strut and at least one side strut to form the sub-frame structure with front wheels forward of rear wheels mounted on the sub-frame on which the luggage apparatus is moved; and in the upright mode, the rear wheels of the sub-frame are retracted towards the front wheels of the sub-frame and, in a tilt mode, the sub-frame is extended in a generally horizontal plane with the rear wheels of the sub-frame extended away from the front wheels to define a relatively larger separation or elongation distance between the front and rear wheels.

9. The luggage apparatus as claimed in claim 8 wherein, in the upright mode, the rear wheels are located generally about the rear of the bag frame base corners and, in a tilt mode, the rear wheels are located beyond the bag frame base corners.

10. The luggage apparatus as claimed in claim 8 wherein the sub-frame elongation and retraction in a generally horizontal plane occurs via at least one sub-frame side strut extending and retracting to extend the rear wheels away from the front wheels.

11. The luggage apparatus as claimed in claim 10 wherein the sub-frame comprises two extending and retracting side struts, the side struts located on either side of the sub-frame generally coincident with each side of the bag frame.

12. The luggage apparatus as claimed in claim 1 wherein, in tilt mode, the bag frame tilts at an angle of 5-45 degrees relative to a vertical plane and, in an upright mode, the bag frame is in a substantially vertical plane about a fixed pivot axis about the front of the bag frame and front of the sub-frame.

13. The luggage apparatus as claimed in claim 1 wherein the sub-frame attaches to the bag frame via at least one front link member, the, or each, front link member having an elongated shape with opposing ends and the, or each, front link member comprises a pivot axis about the sub-frame attachment point, the pivot axis allowing rotational movement between the bag frame and sub-frame about a vertical plane.

14. The luggage apparatus as claimed in claim 1 wherein the sub-frame attaches to the rear of the bag frame via at least one rear member that bridges the sub-frame to the rear of the bag frame, the rear member(s) being located flush with the bag frame when the luggage apparatus is in upright mode and the rear member(s) pivoting out from the bag frame when in tilt mode.

15. The luggage apparatus as claimed in claim 1 wherein the luggage apparatus further comprises a handle that extends and retracts from the bag frame and the handle position relative to the bag is independent of the sub-frame so that the handle is configured to be extracted and retracted from the bag frame without need to adjust the sub-frame.

16. A method of configuring a luggage apparatus between an upright mode and tilt mode, the method comprising the steps of:

providing a luggage apparatus as claimed in claim 1; and extending the sub-frame from a retracted position to an elongated position and in doing so, urging the bag frame to tilt to a tilt mode.

17. The method of claim 16, further comprising the step of:

retracting the sub-frame from an elongated position to a retracted position and in doing so, urging the bag frame from a tilt mode to an upright mode position.

18. A luggage apparatus comprising a bag frame and sub-frame, the luggage apparatus configured to move between an upright mode with the bag frame in a substantially upright orientation and a tilt mode with the bag frame on an angle relative to a vertical plane, the sub-frame and bag frame geometry defined by only three pivot axes, rotation about the three pivot axes moving the bag frame between the upright mode and tilt modes; and wherein the sub-frame attaches to the rear of the bag frame via at least one rear member that bridges the sub-frame to the rear of the bag frame, the rear member(s) being located flush with the bag frame when the luggage apparatus is in upright mode and the rear member(s) pivoting out from the bag frame when in tilt mode.

19. A method of configuring a luggage apparatus between an upright mode and tilt mode, the method comprising the steps of:

providing a luggage apparatus as claimed in claim 18; and extending the sub-frame from a retracted position to an elongated position and in doing so, urging the bag frame to tilt to a tilt mode.

20. The method of claim 19, further comprising the step of:

retracting the sub-frame from an elongated position to a retracted position and in doing so, urging the bag frame from a tilt mode to an upright mode position.

* * * * *